United States Patent [19]

Kida

[11] Patent Number: 4,928,586

[45] Date of Patent: May 29, 1990

[54] SHEET REVERSING UNIT FOR SHEET PRINTING PRESS

[75] Inventor: Kenji Kida, Ibaraki, Japan

[73] Assignee: Kormori Printing Machinery Co., Ltd., Japan

[21] Appl. No.: 380,725

[22] Filed: Jul. 13, 1989

Related U.S. Application Data

[63] Continuation of Ser. No. 178,772, Mar. 31, 1988, abandoned, which is a continuation of Ser. No. 15,976, Feb. 18, 1987, abandoned.

[51] Int. Cl.[5] ..... B41F 21/04; B41F 21/10

[52] U.S. Cl. ..... 101/230; 101/411

[58] Field of Search ..... 101/230, 231, 409, 410, 101/411, 412; 74/53

[56] References Cited

U.S. PATENT DOCUMENTS

| | | | |
|---|---|---|---|
| 2,070,633 | 2/1937 | Topham | 74/53 |
| 3,463,484 | 8/1969 | Rudolph | 101/409 X |
| 3,992,993 | 11/1976 | Kühn et al. | 101/230 |

*Primary Examiner*—J. Reed Fisher

*Attorney, Agent, or Firm*—Remy J. VanOphem

[57] ABSTRACT

A sheet reversing unit for a sheet printing press which includes a reversing gripper device and a suction lever. A cam follower is pivotally mounted on a cam lever and is brought into contact with a cam surface of a cam mechanism for opening and closing the sheet gripper. A regulating cam is arranged outside the moving path of the cam follower, so as to prevent the cam follower from falling outside its normal moving path.

3 Claims, 4 Drawing Sheets

FIG.3 (a) PRIOR ART
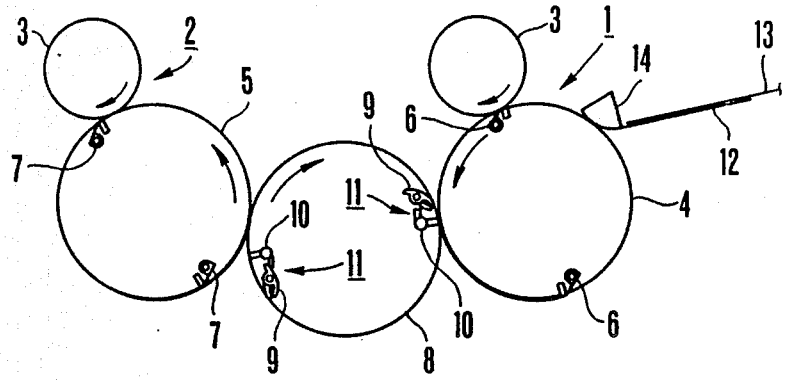
FIG.3 (b) PRIOR ART
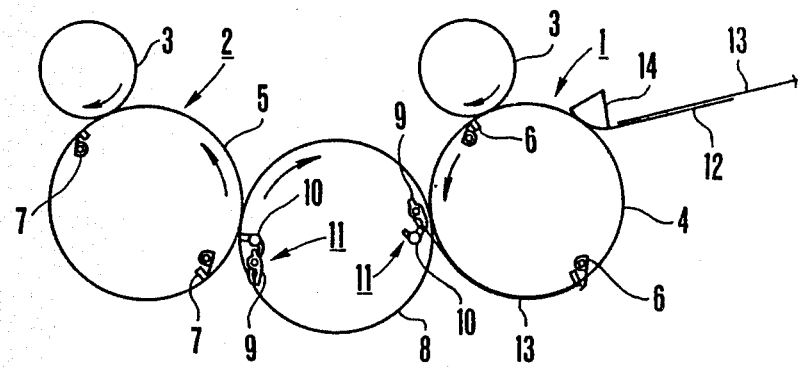
FIG.3 (c) PRIOR ART
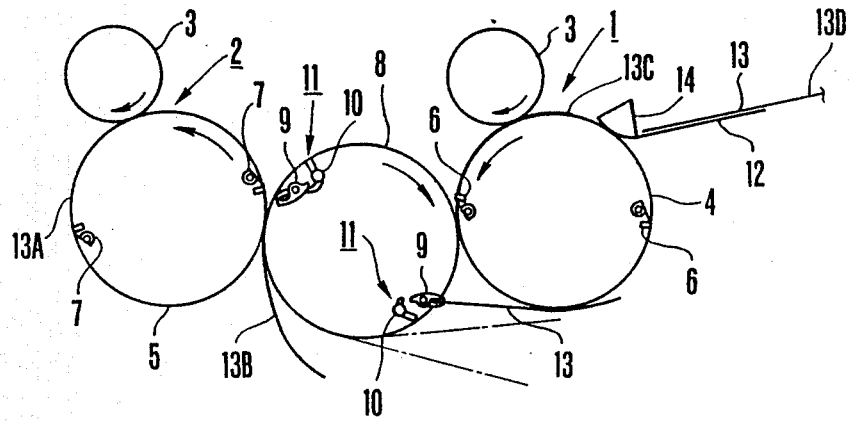

SHEET REVERSING UNIT FOR SHEET PRINTING PRESS

This is a continuation of application Ser. No. 07/178,772, filed Mar. 31, 1988, which was a file wrapper continuation of application Ser. No. 015,976 filed Feb. 18, 1987, all now abandoned.

BACKGROUND OF THE INVENTION

1. Field of the Invention

The present invention relates to a sheet reversing unit for reversing a sheet between printing units for two-side printing.

2. Description of the Prior Art

A printing press which can be selectively used for both single-side printing and two-side printing has been commercially available to satisfy various needs in printing. A printing press of this type has a sheet reversing unit for reversing a sheet whose one surface has already been printed and then conveying it to the next printing unit for two-side printing.

The two-side printing operation of the printing press having this sheet reversing unit will be described with reference to FIG. 3. Two printing units 1 and 2 of the printing press have a rubber blanket cylinder 3, each of which is in contact with a corresponding plate cylinder (not shown), and impression cylinders 4 and 5, each of which is in contact with the corresponding rubber blanket cylinder 3 and each of which has a diameter twice that of the blanket cylinder 3. Gripper devices 6 and 7 (to be referred to simply as grippers 6 and 7 hereinafter) each consist of a gripper and a gripper pad which are arranged in notches that are formed at a position that equally divides the outer peripheries of the impression cylinders 4 and 5. A reversing cylinder 8 is disposed between the two impression cylinders 4 and 5 so that their peripheral surfaces are brought into contact with each other. A reversing device or unit 11 consisting of a reversing gripper 9 and a suction lever 10 is arranged in a notch formed at a position that equally divides the outer periphery of the reversing cylinder 8. Reference numeral 12 denotes a feeder board for stopping a sheet 13 fed from the sheet feeder and registering the sheet end. Reference numeral 14 denotes a swing device for gripping the sheet 13 on the feeder board 12 to be re-gripped by the gripper 6 of the impression cylinder 4.

With the above arrangement, the sheet 13 gripped by the gripper 6 of the impression cylinder 4 is conveyed while being wound around the peripheral surface of the impression cylinder 4 upon rotation of the impression cylinder 4 in the direction indicated by the arrow in FIG. 3. When the sheet 13 passes through the cylinders 3 and 4, an image transferred from the plate cylinder to the rubber blanket cylinder 3 is transferred to a front surface of the sheet 13, thus performing surface printing. When the impression cylinder 4 is further rotated, and the gripper 6 gripping the sheet 13 has passed the contact point between the two cylinders 4 and 8 and the sheet end of the sheet 13 reaches the contact point between the cylinders 4 and 8, as shown in FIG. 3(*b*), the suction lever 10 draws the sheet end which causes the reversing gripper 9 to grip it, and the gripper 6 releases the sheet 13. FIG. 3(*c*) illustrates a state wherein the respective cylinders have been rotated through about 30° from the re-gripping operation. The sheet 13 gripped by the reversing gripper 9 is about to be wound around the reversing cylinder 8 as it was wound around the impression cylinder 4 so that its non-printing surface faces the peripheral surface of the reversing cylinder 8. Reference numerals 13A and 13B denote proceeding sheets; and 13C and 13D, following sheets. The gripped end of the sheet 13 wound around the reversing cylinder 8 reaches the contact point between the cylinders 8 and 5 upon rotation of the respective cylinders like the sheet 13B, and the sheet 13 is re-gripped from the reversing gripper 9 to the gripper 7. When the respective cylinders are further rotated, the sheet 13 is reversed so that the printed surface faces the peripheral surface of the impression cylinder 5. The sheet 13 is then wound around the impression cylinder 5. Thereafter, in the printing unit 2, the printing operation is performed as in the printing unit 1. In this case, since the sheet 13 is reversed, an image is printed on its back surface.

The two-side printing operation has been described schematically. The arrangement and operation of the reversing unit 11 will be described in more detail with reference to FIGS. 4 and 5. FIG. 4 is an enlarged side view of the reversing unit which has passed the contact point with the impression cylinder 5 and is rotated toward the contact point with the impression cylinder 4, and FIG. 5 is an enlarged side view of the reversing unit at the contact point with the impression cylinder 4. In FIGS. 4 and 5, a gripper shaft 15 and a hollow suction lever shaft 16 are axially suspended in the notch of the outer peripheral portion of the reversing cylinder 8 and parallel to a cylinder shaft. These shafts 15 and 16 are alternately oscillated in the normal and reverse directions through a predetermined angle at a predetermined timing through the mesh between segment gears which are driven by a cam mechanism arranged on a frame (not shown) and pinions on the shafts 15 and 16. The reversing gripper 9 consists of a gripper holder 17 fixed to the gripper shaft 15 and a pivotal gripper pad holder 18. A gripper 20 for gripping the sheet 13 between itself and a gripper pad 19 fixed to the distal end portion of the gripper pad holder 18 is pivotally mounted on the distal end portion of the gripper pad holder 18. Reference numeral 21 denotes a gripper spring for biasing the gripper pad holder 18 in the closing direction of the gripper 19; and 22, a gripper spring for applying a gripping pressure to the gripper 19. The reversing gripper 9 with the above arrangement is pivoted between positions shown in FIGS. 4 and 5 together with the gripper shaft 15 which is reciprocated by the cam mechanism. A roller lever which is swung by the cam mechanism on the frame side (not shown) is fixed to one end of the gripper shaft 15, so as to open and close the gripper 20 at the position shown in FIG. 5. Additionally, the suction lever 10 consists of an L-shaped lever 23 which is fixed to the suction lever shaft 16 at a phase different from that of the reversing gripper 9 in the axial direction, and a suction port 24 mounted on one free end portion. The suction port 24 is connected to a suction air source through a hollow portion of the suction lever shaft 16, a rotary valve, and the like. The suction lever 10 is pivoted, between the positions shown in FIGS. 4 and 5, together with the suction lever shaft 16 which is reciprocated by the cam mechanism. Note that a stopper 25 projecting from the lever 23 is formed to have the same phase as that of the gripper pad holder 18 in the axial direction.

With the above arrangement, when the reversing unit 11 is located on the upper side of the reversing cylinder 8, the reversing gripper 9 is stopped in position while a stopper 26 abuts against a stopper 27 of the reversing cylinder 8, as shown in FIG. 4. The suction lever 10 is stopped in position while the stopper 25 abuts against the gripper pad holder 18. When the respective cylinders are rotated and the reversing unit 11 reaches the position shown in FIG. 5, only the suction lever 10 is pivoted counterclockwise by the cam mechanism to the position shown in FIG. 5, and then the reversing gripper 9 is pivoted clockwise by another cam mechanism to the position shown in FIG. 5. Thus, since the stopper 25 is separated from the tail portion of the gripper pad holder 18, the suction lever 10 is again returned to the position shown in FIG. 4, causing the sheet end to be drawn by the suction port 24, and is then pivoted counterclockwise to provide the state shown in FIG. 5. At this time, the gripper shaft 15 is oscillated through a predetermined angle by another cam for opening and closing the gripper, and only the gripper holder 17 is opened and closed, thereby gripping the sheet end between the gripper 20 and the gripper pad 19. When the respective cylinders are further rotated, the gripper opening and closing cam is disabled, and a reversing cam pivots the gripper shaft 15, so that the reversing gripper 9 gripping the sheet end and the suction lever 10 are returned to the positions shown in FIG. 4. In this case, since the suction lever 10 returns to the position shown in FIG. 4 slightly after the reversing gripper 9 does, the stopper 25 does not interfere with the tail portion of the gripper pad holder 18. When the reversing gripper 9 and the suction lever 10 are returned to the positions shown in FIG. 4, a cam follower of the cam mechanism for driving them is moved along a downwardly inclined surface from a large-diameter portion to a small-diameter portion of the cam surface, and the cam follower is urged against the cam surface by the biasing force of a spring member.

However, in the conventional sheet reversing unit as described above, when the reversing gripper 9 is returned from the position shown in FIG. 5 to the position shown in FIG. 4, the cam follower is moved along the downwardly inclined surface while being biased by the spring. When the printing press is operated at high speed, the biasing force of the spring cannot follow the rotation of the cam, and the cam follower floats from the cam surface, resulting in so-called cam skip. This may delay a pivot timing of the reversing gripper. As a result, when the suction lever 10 is pivoted after the reversing gripper 9 catches up with the cam surface, the stopper 25 interferes with the tail portion of the gripper pad holder 18, as shown in FIG. 6, so that the tail portion or its surrounding parts may be damaged. In particular, this phenomenon may often occur when the printing mode is switched from the single-side printing mode to the two-side printing mode for long periods and when high-speed printing is performed, resulting in poor reliability.

SUMMARY OF THE INVENTION

It is a principal object of the present invention to provide a highly reliable sheet reversing unit for a sheet printing press, which prevents damage of parts due to their interference during a high-speed printing operation.

In order to achieve the above object, there is provided a sheet reversing unit for a sheet printing press, including a reversing gripper device which has a sheet gripper which is opened and closed by a cam mechanism and is pivoted between two gripping positions by another cam mechanism. A suction member arranged adjacent to the reversing gripper device is driven by still another cam mechanism, and is pivoted between a sheet suction position and a sheet gripping position by a cam mechanism. A cam lever on which a cam follower is brought into contact with a cam surface of the cam mechanism for opening and closing the sheet gripper that is pivotally mounted by being attached to a pivot shaft to which the reversing gripper device is attached. Regulating means is arranged outside a moving path of the cam follower and is pivoted together with the pivot shaft after a sheet is gripped.

BRIEF DESCRIPTION OF THE DRAWINGS

FIGS. 1 and 2 show a sheet reversing unit for a sheet printing press according to an embodiment of the present invention, in which:

FIG. 1 is a side view showing a portion of a reversing cylinder for depicting the arrangement and operation of the sheet unit; and FIG. 2 is a part sectional front view of the reversing cylinder and a reversing gripper driving section;

FIGS. 3(*a*), 3(*b*), 3(*c*) through FIG. 6 show a conventional sheet reversing unit of a sheet printing press, in which:

FIGS. 3(*a*), 3(*b*), and 3(*c*) are side views showing the operation of the reversing unit;

DETAILED DESCRIPTION OF THE PREFERRED EMBODIMENT

Figure 4:
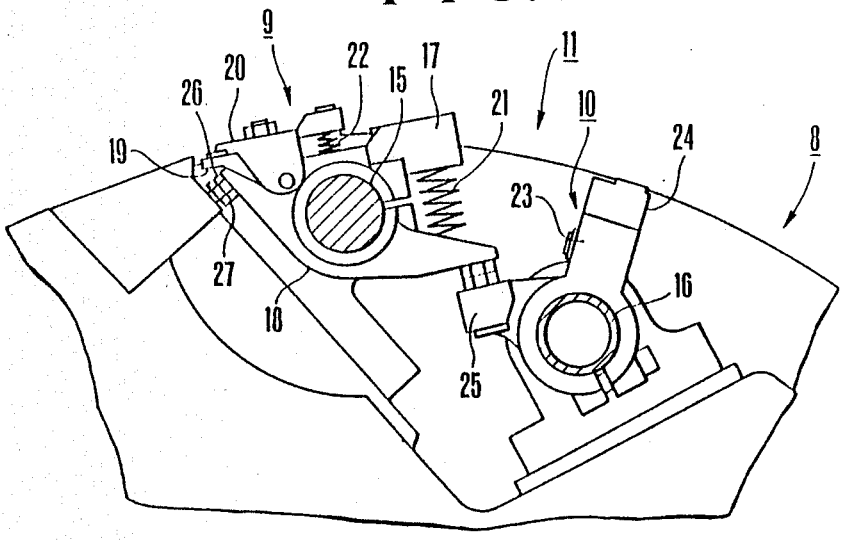
FIG.4 PRIOR ART
FIG. 4 is a detailed side view of the reversing unit in a state before the reversing gripper is pivoted for sheet gripping and after the gripper is returned after sheet gripping.
Figure 5:
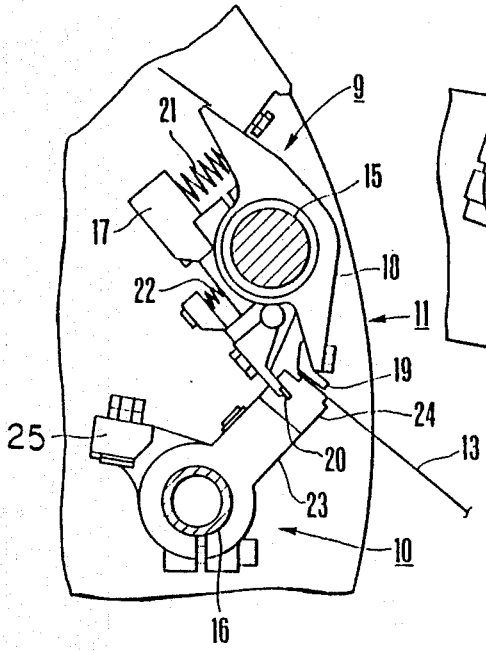
FIG.5 PRIOR ART
FIG. 5 is a detailed side view of the reversing unit in the sheet gripping state.

An embodiment of the present invention will now be described with reference to FIGS. 1 and 2. The same reference numerals in FIGS. 1 and 2 denote the same parts as in FIGS. 3 to 6, and a detailed description thereof will be omitted. A reversing cylinder 8 is axially supported by right and left frames 30 of the printing press. A gripper shaft 15 is supported by two bearers 8*b* which are axially suspended in an outer peripheral notch 8*a* of the reversing cylinder 8. A reversing gripper 9 consisting of a gripper holder 17 whose shaft is fixed and a pivotal gripper base holder 18 is axially mounted on the gripper shaft 15. A gear shaft 31 which receives a clockwise pivotal force in FIG. 1 from a torsion bar (not shown) is axially supported by the two bearers 8*b* of the reversing cylinder 8, and a gear segment 33 which meshes with a pinion 32 on the gripper shaft 15 is fixed to a projecting portion of the gear shaft 31. Reference numeral 34 denotes a reversing cam which is fixed to the frames 30 adjacent to the contact portion between the reversing cylinder 8 and an impression cylinder 4. The reversing cam 34 has small-diameter and large-diameter portions concentric with the reversing cylinder 8 and a cam surface consisting of upwardly and downwardly inclined surfaces therebetween. A cam follower 35 which is pivotally mounted on the gear segment 33 is urged against the cam surface by the biasing force of the torsion bar. When the reversing cylinder 8 is rotated and the cam follower 35 is brought into contact with the small-diameter portion of the reversing cam 34, the reversing gripper 9 is located at a position indicated on the upper portion of the reversing cylinder 8 in FIG. 1 (a position described with reference to FIG. 4). When the cam follower 35 is moved along the upwardly inclined surface and is brought into contact with the large-diameter portion, the reversing gripper 9 is pivoted and is then located at a position shown in the right side portion of the reversing cylinder 8 in FIG. 1 (a position described with reference to FIG. 5). When the reversing cylinder 8 is further rotated from this position, and the cam follower 35 is moved along the downwardly inclined surface of the reversing cam 34, the reversing gripper 9 is pivoted and is then returned to the position indicated in the lower portion of the reversing cylinder 8 shown in FIG. 1.

Figure 1:
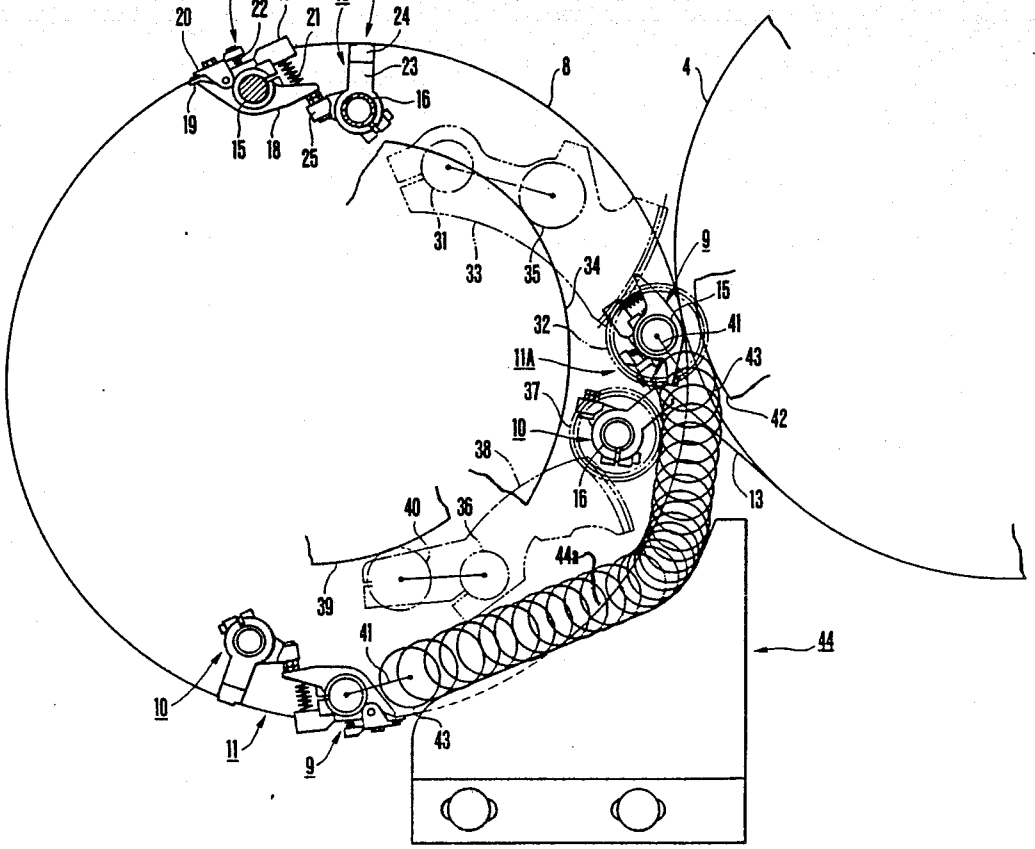
Figure 2:
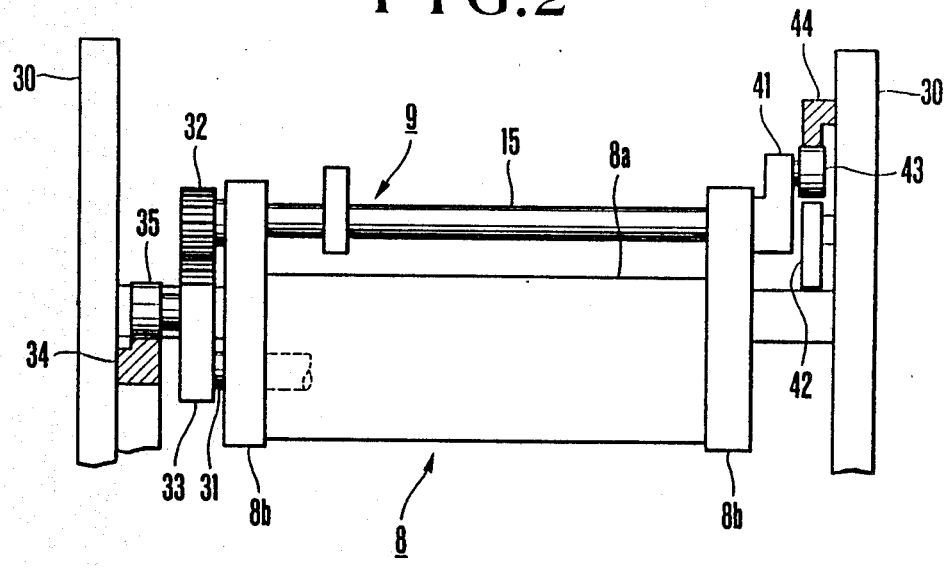

Although omitted from FIG. 2, a suction lever shaft 16 is axially suspended in the notch 8*a* of the reversing cylinder 8 to be parallel to the gripper shaft 15. The suction lever 10 is axially mounted on the suction lever shaft 16. A gear shaft 36 to which a clockwise pivotal force in FIG. 1 is applied by a torsion bar (not shown) is axially supported between the bearers 8*b* of the reversing cylinder 8. A gear segment 38 which meshes with a pinion 37 on the suction lever shaft 16 is fixed to the gear shaft 36. Reference numeral 39 denotes a suction lever cam which is fixed to the frames 30 that are adjacent to the contact portion between the reversing cylinder 8 and the impression cylinder 4. The cam 39 has small-diameter and large-diameter portions concentric with the reversing cylinder 8 and a cam surface consisting of upwardly and downwardly inclined surfaces therebetween. A cam follower 40 which is pivotally mounted on the gear segment 38 is urged against the cam surface by the biasing force of the torsion bar. When the reversing cylinder 8 is rotated and the cam follower 40 is brought into contact with the small-diameter portion of the suction lever cam 39, the suction lever 10 is located at a position indicated in the upper portion of the reversing cylinder 8 in FIG. 1 (a position described with reference to FIG. 4). When the cam follower 40 is moved along the upwardly inclined surface of the suction lever cam 39 and is brought into contact with the large-diameter portion, the suction lever 10 is pivoted and is located at a position indicated in a right side portion of the reversing cylinder 8 (a position described with reference to FIG. 5). When the reversing cylinder 8 is further rotated from this position, the cam follower 40 is moved along the downwardly inclined surface of the suction lever cam 39, and the suction lever 10 is pivoted to be located at a position indicated in the lower portion of the reversing cylinder 8 in FIG. 1.

Although not shown in detail in FIG. 1, a cam lever 41 is axially mounted on the projection of the gripper shaft 15 on the side of the pinion 32, and a gripper opening and closing cam 42 has an arcuated partial cam formed on the frame 30 on this side to be concentric with the impression cylinder 4, and is in fixed position relative to the contact position between the cylinders 4 and 8 at its center. A cam follower 43 which is pivotally mounted on the cam lever 41 is brought into contact with the gripper opening and closing cam 42. During the contact, when the cam follower 43 goes beyond the projecting portion of the gripper opening and closing cam 42, the gripper 20 is opened and closed. After the gripper 20 is closed by means of the opening and closing cam 42, since the cam follower 43 is separated from the opening and closing cam 42, the cam lever 41 swings upon pivotal movement of the gripper shaft 15 by means of the reversing cam 34.

The cam follower 43 pivotally mounted on the cam lever 41 which swings upon pivotal movement of the gripper shaft 15 travels as shown in FIG. 1. More specifically, as described above, the reversing gripper 9 which has passed the opposing position with the impression cylinder 4 is pivoted counterclockwise together with the gripper shaft 15 since the cam follower 35 is moved along the downwardly inclined surface of the reversing cam 34, and the cam lever 41 which is integral with the gripper shaft 15 swings. Then, these movements are synchronized with the peripheral movement of the gripper shaft 15 upon rotation of the reversing cylinder 8, and the cam follower 43 is moved along a V-shaped path. A regulating cam 44 for preventing the cam follower 43 from falling outside the normal travel path is fixed to the frame 30 at a position outside the travel path of the cam follower 43. More specifically, the regulating cam 44 includes a cam surface 44*a* which contacts with the cam follower 43 to have a very small gap therebetween. Even if the cam follower 35 that moves along the downwardly inclined surface of the reversing cam 34 remains floating from the cam surface due to its inertia, since the pivotal movement of the gripper shaft 15 is regulated by the cam follower 43 which is held in contact with the regulating cam 44, the reversing gripper 9 is accurately moved along the cam surface of the reversing cam 34, and the pivotal timing will not be delayed.

Figure 6:
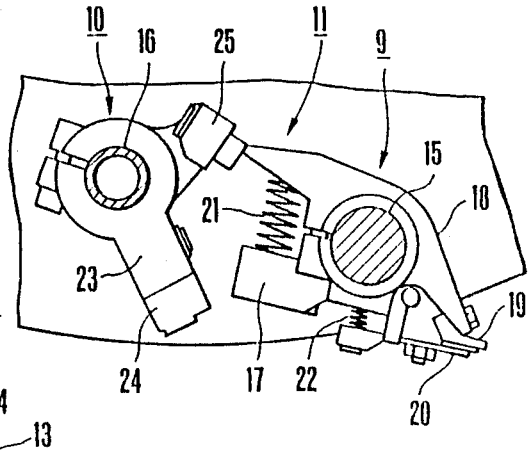
FIG. 6 is a detailed side view of the reversing unit in the state wherein the reversing gripper interferes with a suction lever.

The operation of the sheet reversing unit with the above arrangement will be described below. When the reversing cylinder 8 is rotated from a state wherein the reversing unit 11 is located on the upper side of the reversing cylinder 8 and reaches the opposing point with the impression cylinder 4, the cam follower 40 is moved from the large-diameter portion to the small-diameter portion of the suction lever cam 39, and the suction lever 10 is pivoted counterclockwise. Thereafter, the cam follower 35 is moved along the upwardly inclined surface of the reversing cam 34, and the reversing gripper 9 is pivoted clockwise. The cam follower 40 then goes beyond the projecting portion of the suction lever cam 39, so that the suction lever 10 is swingably pivoted, thereby drawing the sheet end of the sheet 13 to move it to the sheet gripping position. The reversing gripper unit indicated by reference numeral 11A in FIG. 1 represents this state. At this position, the cam follower 43 enters the gripper opening and closing cam 42 and passes its large-diameter portion, and then the gripper 20 is opened and closed to grip the sheet end. When the reversing cylinder 8 is kept rotated from this state, the cam follower 35 is moved to the small-diameter portion of the reversing cam 34, and the reversing gripper 9 is pivoted counterclockwise. After some movement, the cam follower 40 is moved to the large-diameter portion of the suction lever cam 39, and the suction lever 10 is pivoted slightly later than the reversing gripper 9. Upon pivotal movement of the reversing gripper 9, the cam follower 35 is moved along the downwardly inclined surface of the reversing cam 34, so that the cam follower 35 tends to float from the cam surface 34 due to its inertia during high-speed rotation. However, according to the invention, when the cam follower 43 tends to be separated from the cam surface, the gripper opening and closing cam 42 is moved while being in contact with the cam surface of the regulating cam 44, the pivotal movement of the gripper shaft 15 is regulated, and the cam follower 35 is moved while being urged against the cam surface 34 without floating. Thus, the pivotal movement of the reversing gripper 9 will not be delayed from the normal movement. Therefore, as shown in FIG. 6, the stopper 25 of the suction lever 10 which is pivoted after the reversing gripper 9 will not interfere with the tail portion of the gripper pad holder 18.

As described above, before gripping the sheet 13, the reversing gripper 9 and the suction lever 10 are moved to prevent interference between the stopper 25 and gripper pad holder 18. In this case, since the cam follower 35 is moved along the upwardly inclined surface of the reversing cam 34, the cam follower 35 does not float from the cam surface, and there is no fear of interference between the stopper 25 and the gripper pad holder 18.

As can be seen from the above description, in a sheet reversing unit for a sheet printing press, a cam lever which is brought into contact with a cam surface of a cam mechanism for opening and closing a gripper of a reversing gripper device is fixed to a pivot shaft to which the reversing gripper device is fixed. A regulating cam having a cam surface which contacts a cam follower so as not to fall outside a normal moving path is provided outside the moving path of the cam follower which is pivoted together with the pivot shaft after a sheet is gripped. When a reversing gripper and a suction lever are pivoted to be returned to their original positions after the sheet is gripped, a gripper shaft together with the cam follower whose movement is regulated is accurately moved along the cam surface of a cam mechanism for pivoting the reversing gripper, and the pivotal movement of the reversing gripper will not be delayed. Therefore, the reversing gripper and the suction lever will not interfere with each other, and damage to these and surrounding parts can be prevented, thereby improving reliability.

What is claimed is:

1. A sheet reversing unit for a sheet printing press, said sheet reversing unit comprising:

a sheet reversing cylinder rotatably mounted to a sheet printing press frame, said sheet reversing cylinder having a peripheral surface and at least one notch in said peripheral surface;

means mounted to said sheet printing press frame for rotating said sheet reversing cylinder;

first and second reversing cam surface means attached to said sheet printing press frame, said first reversing cam surface means having smaller and larger diameter portions concentric with said sheet reversing cylinder and cam surface portions of upwardly and downwardly inclined surfaces therebetween;

reversing gripper means pivotally mounted in said at least one notch of said sheet reversing cylinder for gripping a sheet, said reversing gripper means further comprising:

at least one sheet reversing gripper;

a gripper opening and closing can means mounted to said sheet printing press frame in spaced relationship to said sheet reversing cylinder; and at least one gripper opening and closing cam follower means mounted in spaced relationship to said gripper opening and closing cam means to open and close said at least one sheet reversing gripper;

reversing cam follower means mounted to said sheet reversing cylinder, said reversing cam follower means being brought into contact with said first reversing cam surface means for pivoting said reversing gripper means;

suction lever means pivotally mounted in said at least one notch of said sheet reversing cylinder for holding said sheet by suction;

means for providing suction to said suction lever means;

suction lever cam follower means mounted to said sheet reversing cylinder, said suction lever cam follower means being brought into contact with said second reversing cam surface means for pivoting said suction lever means; and regulating cam means attached to said sheet printing press frame for regulating said reversing cam follower means, said regulating cam means having a cam surface in spaced relationship to said opening and closing cam follower means, whereby said opening and closing cam follower means and said regulating cam means selectively cooperate to ensure the pivoting movement of said at least one sheet reversing gripper as said reversing cam follower means travels along said first reversing cam surface means from said larger diameter portions and along said downwardly inclined surface of said cam surface portions such that said reversing cam follower means is maintained in engaging contact with said first reversing cam surface means.

2. The sheet reversing unit of claim 1, wherein said reversing gripper means comprising said at least one sheet reversing gripper is pivotally mounted to said sheet reversing cylinders, said at least one sheet reversing gripper being actuated between an open position for receiving said sheet and a closed position for holding said sheet.

3. The sheet reversing unit of claim 2, wherein said first and second reversing cam surface means comprises a first reversing cam surface and a second reversing cam surface; and wherein said reversing cam follower means comprises a first reversing cam follower for engaging said first reversing cam surface for pivoting said at least one sheet reversing gripper, said opening and closing cam follower means selectively contacting said cam surface of said regulating cam means prior to contacting said gripper opening and closing cam means.

* * * * *

UNITED STATES PATENT AND TRADEMARK OFFICE

CERTIFICATE OF CORRECTION

PATENT NO. : 4,928,586

DATED : May 29, 1990

INVENTOR(S) : Kenji Kida

It is certified that error appears in the above-identified patent and that said Letters Patent is hereby corrected as shown below:

Column 4, line 4, delete "which".

In the Claims

Column 8, line 4, delete "can" and insert ---- cam ----.

Column 8, line 44, delete "cylinders" and insert ---- cylinder ----.

Signed and Sealed this

Second Day of July, 1991

*Attest:*

*Attesting Officer*

HARRY F. MANBECK, JR.

*Commissioner of Patents and Trademarks*